US007655902B2

(12) United States Patent
Choi et al.

(10) Patent No.: US 7,655,902 B2
(45) Date of Patent: Feb. 2, 2010

(54) NANOWIRE ASSISTED LASER DESORPTION/IONIZATION MASS SPECTROMETRIC ANALYSIS

(75) Inventors: Heon Jin Choi, Seoul (KR); Jae Chul Pyun, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 475 days.

(21) Appl. No.: 10/592,971

(22) PCT Filed: Mar. 15, 2005

(86) PCT No.: PCT/KR2005/000738

§ 371 (c)(1),
(2), (4) Date: Sep. 15, 2006

(87) PCT Pub. No.: WO2005/088293

PCT Pub. Date: Sep. 22, 2005

(65) Prior Publication Data

US 2008/0245961 A1 Oct. 9, 2008

(30) Foreign Application Priority Data

Mar. 17, 2004 (KR) ..... 10-2004-0017901

(51) Int. Cl.
*H01J 49/00* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS 6,288,390 B1 9/2001 Siuzdak et al. ..... 250/288
2003/0052006 A1 3/2003 Noca et al. ..... 204/450

(Continued)

FOREIGN PATENT DOCUMENTS

JP 08-315633 11/1996

(Continued)

OTHER PUBLICATIONS

Min-Jung Kang, et al., "Application of Automated Matrix-Assisted Laser Desorption/Ionization Time-of-Flight Mass Spectrometry For The Measurement Of Enzyme Activities", Rapid Commun. Mass Spectrom. 2001; 15: pp. 1327-1333.

(Continued)

*Primary Examiner*—Jack I Berman
*Assistant Examiner*—Hanway Chang
(74) *Attorney, Agent, or Firm*—Frommer Lawrence & Haug LLP; Ronald R. Santucci

(57) ABSTRACT

This invention relates to a nanowire-assisted method for mass spectrometric analysis of a specimen. More specifically, by using nanowire which can fix a specimen and perform desorption/ionization of the specimen while effectively transferring laser energy to the specimen to be irradiated, thereby enabling to perform mass spectrometric analysis without using a matrix solution. This invention, by effectively performing desorption/ionization of a specimen using the above-mentioned nanowire, enables to effectively perform qualitative-, quantitative-, and micro-analyses of specimens as well as low molecular weighted specimens. Further, this invention enables to the typical device of mass spectrometric analysis used in MALDI-T of MS. In particular, this invention can perform mass spectrometric analysis of a specimen with molecular weight of less than 1,000 Da and perform quantitative analysis by fixing a specimen with a predetermined area.

27 Claims, 4 Drawing Sheets

U.S. PATENT DOCUMENTS

2008/0073505 A1* 3/2008 Niu et al. ..... 250/288

FOREIGN PATENT DOCUMENTS

KR 10-2001-0081780 6/2003

OTHER PUBLICATIONS

Jing Wei, et al., "Desorption-Ionization Mass Spectrometry on Porous Silicon", (1999) Nature, vol. 399, 243-246.

Warren G. Lewis, et al., Desorption/Ionization on Silicon (DIOS) Mass Spectrometry: Background and Applications, International Journal of Mass Spectrometry, 226 (2003) pp. 107-116.

Justin C. Johnson, et al., Single Gallium Nitride Nanowire Lasers, Nature Materials, vol. 1, Oct. 2002) pp. 106-110.

Vladimir E. Frankevich, "Role of Electrons in Laser Desorption/Ionization Mass Spectrometry", Analytical Chemistry, vol. 75 No. 22, Nov. 15, 2003, pp. 6063-6067.

G/ Suizdak, 1. Ion Sources and Sample Introduction, In: Mass Spectroscopy for Biotechnology, Academic Press, 1996, p. 13.

J.M. Bermond, et al. Sur. Sci. 42 (1974) p. 306.

* cited by examiner

NANOWIRE ASSISTED LASER DESORPTION/IONIZATION MASS SPECTROMETRIC ANALYSIS

This application is a 371 of PCT/KR2005/000738 filed on Mar. 15, 2005, published on Sep. 22, 2005 under publication number WO 2005/088293 A1 which claims priority benefits from Korean Patent Application No. 10-2004-0017901 filed Mar. 17, 2004.

TECHNICAL FIELD

This invention relates to a nanowire-assisted method for mass spectrometric analysis of a specimen. More specifically, this invention, by using nanowire, can fix a specimen and perform desorption/ionization of the specimen while effectively transferring laser energy to the specimen to be irradiated, thereby performing mass spectrometric analysis without using a matrix solution.

BACKGROUND OF INVENTION

Mass spectrometer is an analytical device for measuring a mass of a compound. It generally determines molecular weight of a compound by measuring the value of mass-to-charge (m/z) by ionizing the compound by charging. There are many methods to ionize a compound such as electron ionization using electron beams, high speed collision of atoms, a method using laser, and a method to spray a specimen into an electric field.

For a biochemical substance with an extremely large mass such as proteins and nucleic acids, MALDI-T of Mass Spectroscopy (Matrix Assisted Laser Desorption/Ionization Time of Flight Mass Spectroscopy; hereinafter MALDI), which uses laser, has been used and various analytic devices of this kind have been recently developed and are commercially available at present. These devices can measure molecular weight of polymers with molecular weight of 300 kDa or higher by using matrix which not only assists the transfer of energy to a substance to be analyzed but also facilitates ionization of the substance. Besides, analyses of specimens at the level of femto moles are also possible due to their relatively high sensitivity, and also help to greatly reduce the breakage of a compound during ionization process thereby enabling the analyses of mixtures.

For the MALDI-assisted mass spectrometry, specimens are prepared as follows.

(1) A small amount of matrix solution is added onto a target board made of a metal plate, dried and then a specimen solution to be analyzed is further added on top of it and dried; or A matrix substance is mixed with a specimen solution, placed onto a target plate and then crystallized.

(2) The area of the matrix and crystallized specimen is irradiated with laser and the specimen becomes desorbed/ionized being assisted with the matrix.

Typical mass spectrometer has a structure that it applies an electric field between the target board where a specimen is located and a sensor for mass analysis so that ionized specimen can be moved into a sensor due to the difference in potentials. In case that the electric charge of a specimen is already known the mass of the specimen can be analyzed based on variables such as the time required for the specimen to reach the sensor.

The above MALDI method is very useful for mass analysis but it is still necessary to select a matrix substance suitable for ionization depending on the properties of a specimen.

Examples of the matrix substance are nicotinic acid, cinnamic acid, 2,5-dihydroxybenzoic acid and the like. These matrix substances are known to generate protons by absorbing energy being irradiated and bind them to a specimen thereby facilitating the ionization of the specimen. However, the exact mechanism of the ionization is yet to be elucidated and therefore it is challenging to select a suitable matrix substance for a given specimen.

Besides, MALDI has a disadvantage that its use is largely limited to substances having a molecular weight greater than 1,000 Da because low molecular weighted matrix substance and matrix decomposed product are indicated on the mass spectrometry spectrum in the course of ionization of a specimen by a laser-activated matrix.

In addition, the ionization of a decomposed product is determined according to the selection of a matrix and thus it becomes necessary to select a most suitable matrix substance and it becomes difficult to perform an analysis for an unknown substance in a mixture (G. Suizdak, 1. Ion sources and sample introduction, In: Mass spectroscopy for biotechnology, Academic press, 1996, p 13).

Further, MALDI method has another disadvantage that the spatial distribution of a crystallized specimen obtained via specimen preparation process is not uniform and therefore the amount of a specimen being excited by laser varies depending on the location of irradiation. Therefore, for appropriate quantitative analysis, the various results obtained by irradiating various locations are interpreted statistically. A widely known method for quantitative analysis via MALDI method is to measure spectrum of a compound having an almost identical structure as the one to be analyzed by incorporating an internal standard substance labeled with a radioisotope in a predetermined ratio (M. J. Kang, E. Heinzle, Rapid Communications in Mass Spectrometry, 15 (2001) 1327-1333). However, even with the above method, it is still difficult to perform an accurate quantitative analysis of a specimen via MALDI method.

As a mass analysis method using laser as an energy source for desorption/ionization of a specimen without using matrix there is introduced DIOS MS (Desorption Ionization on Silicon Mass Spectroscopy; hereinafter DIOS). In general, DIOS is a method for analyzing mass of a specimen using porous silicon as a target without matrix. The porous silicon is manufactured by electric etching and DIOS becomes possible by adjusting porosity and degree of oxidation. The porous silicon used in DIOS is expected to provide ionization of a specimen by absorbing laser energy as in the case of matrix but the exact energy transfer pathway for desoprtion/ionization of a specimen is not known yet.

It is known that DIOS enables to perform a quantitative analysis, without using matrix, of substances with high molecular weight such as proteins and nucleic acids as well as compounds with relatively low molecular weight (J. Wel, J. M. Burlak, G. Suizdak, Nature, 399 (1999) 243-246; W. G. Lewis, Z. Shen, M. G. Finn, G. Suizdak, International Journal of Mass spectrometry, 226 (2003) 107-116; U.S. Pat. No. 6,288,390 B1).

Meanwhile, in case of DIOS, a specimen solution penetrates the porous structure of a board and becomes crystallized in the course of injecting a specimen solution on the porous silicon board thus making it difficult to limit the size of crystals and also hard to make the crystal center of a specimen correspond to a point of laser irradiation. For this reason, it is almost impossible to perform a quantitative analysis through 1 to 2 times of measurements of a specimen. Since DIOS is only applicable to silicon, it cannot select an energy transfer medium suitable for various kinds of specimens. Further, an effective desorption/ionization becomes difficult because the laser energy can be transferred via a two-dimensional way.

Therefore, to resolve the above-mentioned problems, the present invention provides a method for a nanowire-assisted laser desorption/ionization mass spectrometric analysis wherein the nanowire, which is used instead of the traditional porous silicon, can fix a specimen and enables to perform mass analysis of a specimen without using a matrix solution while effectively transferring laser energy to a specimen to be irradiated.

DETAILED DESCRIPTION OF INVENTION

The present invention is described in detail as follows.

In an embodiment of the present invention, there is provided a nanowire-assisted method for mass spectrometric analysis of a specimen via desorption/ionization using laser as an energy source comprising:

(a) forming a nanowire spot by growing a plurality of minute nanowires in a selected area of a conductive material or a semiconductor board capable of applying voltage;

(b) placing the specimen containing a substance to be analyzed in the nanowire spot and crystallizing it by drying; and (c) performing mass spectrometric analysis of the ionized material to be analyzed in a state where voltage is applied in the board, while simultaneously irradiating laser onto the nanowire spot, wherein the specimen is adsorbed to and crystallized in the nanowire under reduced pressure, to transfer energy to the specimen through the nanowire.

In another embodiment of the present invention, there is provided a nanowire-assisted method for mass spectrometric analysis of a specimen via desorption/ionization using laser as an energy source comprising:

(a) manufacturing nanowire suspension containing a plurality of minute nanowires;

(b) forming a nanowire islet after drying the nanowire suspension coated on a selected area of a conductive material or a semiconductor board capable of applying voltage;

(c) placing said specimen containing a substance to be analyzed in the nanowire spot and crystallizing it by drying; and (d) performing mass spectrometric analysis of the ionized material to be analyzed in a state where voltage is applied in said board, while simultaneously irradiating laser onto the nanowire spot, wherein the specimen is adsorbed to and crystallized in the nanowire under reduced pressure, to transfer energy to said specimen through the nanowire.

In a still another embodiment of the present invention, there is provided a nanowire-assisted method for mass spectrometric analysis of a specimen via desorption/ionization using laser as an energy source comprising:

(a) manufacturing nanowire suspension by mixing a sample solution containing a plurality of minute nanowires and materials to be analyzed;

(b) forming a nanowire islet comprising nanowire and a specimen adsorbed and crystallized to said nanowire after drying the nanowire suspension coated on the selected area of a conductive material or a semiconductor board capable of applying voltage;

(c) performing mass spectrometric analysis of the ionized material to be analyzed in a state where voltage is applied in said board, while simultaneously irradiating laser onto the nanowire spot, under reduced pressure, to transfer energy to the specimen through said nanowire.

This invention is described further in detail with reference to the accompanying drawings.

This invention relates to a method for a nanowire-assisted laser desorption/ionization mass spectrometric analysis (NADI MS: NADI hereinafter) of a specimen wherein the nanowire, which is used instead of the traditional porous silicon, can fix a specimen and enables to perform mass analysis of a specimen without using a matrix solution while effectively transferring laser energy to a specimen to be irradiated.

Preferred embodiments of the present invention are set forth hereunder.

First, a plurality of minute nanowires are grown in the selected area of the board, which can be used in the typical MALDI process, and nanowire spot is formed therefrom. The board used herein is a conductor or semiconductor board which can apply voltage. Nanowire is preferred to have a diameter of 500 nm or less and an aspect ratio of 10 or higher. If the nanowire is grown to have a diameter of greater than 500 nm it becomes difficult to amplify the laser energy being irradiated or uniform distribution within a specimen while if it is grown to have an aspect ratio of less than 10 it becomes difficult to effectively transfer energy while amplifying the laser energy being irradiated.

The nanowire to be grown is selected from the group consisting of a single metal containing silicon, oxide, carbide, nitride, phosphide and arsenide semiconductor nanowires. Further, it is preferable from the quantitative point of view that the area of the nanowire spot be formed so that it is equal to or smaller than the area being irradiated for desorption/ionization of a specimen.

Then, the specimen containing a substance to be analyzed is placed in an area where the nanowire is grown by using the method in MALDI process so that it can be adsorbed to the nanowire and crystallized by drying. The specimen comprises a salt and a material to be analyzed, wherein the concentration of the salt is greater than 10 mM while the concentration of the material to be analyzed is contained in the specimen less than 1 femto mole.

Then, in a vacuum state same as in the device used for MALDI process, the board where the nanowires and the crystallized specimen is adsorbed to are irradiated with laser on the nanowire spot while during which the ionized specimen is concurrently placed under mass spectrometric analysis in a state where voltage is applied onto the board. Here, desorbed/ionized specimen is being transferred to a sensor by an electric field applied to between a board and a sensor for analysis to perform a mass spectrometric analysis.

Another preferred embodiment of the present invention is given below.

First, a plurality of minute nanowires are grown on a predetermined board and the nanowires are separated from the board and mixed with a volatile solution such as distilled water, aqueous solution or alcohol depending on the kind of nanowire substance and manufacture the nanowire suspension. For example, the nanowire suspension can be prepared by placing the board where nanowires are grown ('nanowire chip' hereinafter) in a volatile solution and then separating the nanowires from the board by applying ultrasonic wave. Or, the nanowire suspension can be prepared by separating the nanowires from the board where the nanowires are grown by scratching and mixing with a volatile solution to spray it on the board. Here, as in the first preferred embodiment, each nanowire is preferred to have a diameter of 500 nm or less and an aspect ratio of 10 or higher. Further, the nanowire is selected from the group consisting of a single metal containing silicon, oxide, carbide, nitride, phosphide and arsenide semiconductor nanowires.

Then, the above nanowire suspension is sprayed onto the selected area of the board that can be used in the typical MALDI process and dried to form a nanowire islet. The board to be used is a conductor or a semiconductor board that can apply voltage. In addition, it is possible that the nanowire islet is formed by spraying the nanowire suspension onto the selected area of the board. Further, the area of the nanowire islet is preferred to have a size equal to or smaller than that of the area to be irradiated by laser for desorption/ionization of a specimen.

Then, the specimen solution containing a substance for mass analysis is coated on the above-mentioned nanowire islet, dried and crystallized. Here, the specimen becomes adsorbed to the nanowires which serve as a cage to hold the specimen within the area of spray so that the mixture of the crystallized specimen and nanowires can be appropriately located. The above specimen consists of a salt and a substance to be analyzed. Preferably, the concentration of the salt is greater than 10 mM while the concentration of the material to be analyzed is contained in the specimen less than 1 femto mole.

Then, in a vacuum state same as in the device used for MALDI process, the board where the nanowires and the desorbed/crystallized specimen are irradiated with laser on the nanowire islet while during which the ionized specimen is concurrently placed under mass spectrometric analysis in a state where voltage is applied onto the board. Here, desorbed/ionized specimen is being transferred to a sensor by an electric field applied in between a board and a sensor for analysis to perform a mass spectrometric analysis.

A still another preferred embodiment of the present invention is given below.

First, a plurality of minute nanowires are grown on a predetermined board and the nanowires are separated from the board and mixed with a specimen solution containing a substance to be analyzed and the nanowire suspension is finally prepared. For example, the nanowire suspension containing nanowires and a specimen can be prepared by placing the board, where nanowires are grown (i.e., 'nanowire chip'), in a volatile solution and then separating the nanowires from the board by applying ultrasonic wave and added with a specimen solution. Or, the nanowire suspension can be prepared by separating the nanowires from the board where the nanowires are grown by scratching and then mixing with a volatile solution to enable a spray on the board. Here, as in the first preferred embodiment, each nanowire is preferred to have a diameter of 500 nm or less and an aspect ratio of 10 or higher. Further, the nanowire is selected from the group consisting of a single metal containing silicon, oxide, carbide, nitride, phosphide and arsenide semiconductor nanowires. The above specimen consists of a salt and a substance to be analyzed. Preferably, the concentration of the salt is greater than 10 mM while the concentration of the material to be analyzed is contained in the specimen less than 1 femto mole.

Then, the above nanowire suspension is sprayed onto a selected area of the board that can be used in the typical MALDI process and dried to form a nanowire islet and the specimen is crystallized. The board to be used is a conductor or a semiconductor board that can apply voltage. In addition, it is possible that the nanowire islet is formed by spraying the nanowire suspension onto the selected area of the board. Further, the area of the nanowire islet is preferred to have a size equal to or smaller than that of the area to be irradiated by laser for desorption/ionization of a specimen.

As stated in the above preferred embodiments, irradiations are performed using laser having an energy greater than the bandgap of nanowires depending on the kind of nanowires, and the vacuum pressure, i.e., atmospheric pressure, is set below $10^{-16}$ torr.

Besides, in applying voltage on the board, about 5,000V to 30,000V is applied and in the course of mass spectrometric analysis of an ionized substance to be analyzed the value of mass over electric charge (m/z) of ions is measured.

In the above-mentioned NADI process, the basic principle of the effective desorption/ionization of a specimen provided by nanowires without using matrix is explained in detail as follows.

Nanowires, upon exposure to laser irradiation, can absorb energy and generate photons, wherein the nanowires themselves have a cavity structure which can amplify photons (1.J. Johnson, Heon-Jin Choi, K. P. Knutsen, R. D. Schaller, P. Yang, R. J. Saykally, "Single Gallium Nitride Nanowire Laser," Nature Materials, 1, 2, 106-110 (2002)). Accordingly, nanowires can spontaneously amplify laser energy being transferred from the outside and again deliver the amplified energy to a specimen in the form of a stimulated emission. Therefore, they can most efficiently deliver energy to a specimen over to any forms of other energy transferring media, and thus facilitate relatively easy desorption/ionization of a specimen.

The nanowires used in the present invention are needle-shaped having a diameter of a few nanometers and a relatively large aspect ratio. Therefore, both ends of the nanowires are of very sharp tips at the level of atom. These geographical structures can generate an extremely high electric field at the front tips of nanowires when an electric field is applied between a board and a sensor in the device for mass spectrometric analysis, and the high electric field at the front tips of nanowires cause field desorption thereby enabling the desorption/ionization of a specimen. Further, they can generate a relatively high electric field at the front tips of nanowires induced by laser upon laser irradiation (J. M. Bermond, M. Lenoir, J. P. Prulhiere, M. Drechsler, Sur. Sci. 42, 306 (1974)). The generation of extremely high local electric field can accelerate the release of desorption/ions release at the front tips of nanowires thereby easing the desorption/ionization of a specimen.

In addition, the geographical shape of the front tips of nanowires can allow release of electrons when an electric field is applied and this electron release can ease the ionization of a specimen (V. E. Frankevich, J. Zhang, S. D. Friess, M. Dashtiev, R. Zenobi, Anal. Chem. 2003, 75, 6063).

In case of DIOS using the traditional porous silicon, only two-dimensional laser irradiation onto a specimen is possible because a specimen solution is injected into a porous structure and becomes dried. However, in the present invention, the crystallized specimen formed on the nanowires, unlike the porous silicon, can be exposed three dimensionally to laser thus more effectively transferring laser energy to a specimen thereby more effectively performing desorption/ionization.

As stated above, the use of nanowires enables to effectively transfer energy to a specimen and promotes easy desorption/ionization thus allowing mass spectrometric performance of a specimen without using matrix.

Further, in NADI process according to the present invention, the specimen distribution within the crystallized specimen thus securing more precise data. That is, the use of nanowires can accurately control the growth location via catalytic patterns on the board. For example, in the step where nanowires are grown on the board according to the present invention, especially when silicon nanowires are grown (in forming nanowire spot), silicon nanowires can be grown by supplying $SiCl_4$ at 500° C. onto the silicon board via chemical vapor deposition (CVD) after depositing Au, a metal serving as a catalyst, on a surface of the silicon board to have a predetermined thickness and diameter with a circular shape using a mask via sputtering vapor deposition method.

Or, in case of growing InN nanowires, InN nanowires can be grown by supplying $InCl_3$ and $NH_3$ at 500° C. onto the silicon board via chemical vapor deposition after depositing Au, a metal serving as a catalyst, on a surface of the silicon board to have a predetermined thickness and diameter with a circular shape using a mask via sputtering vapor deposition method.

In addition, when locating a specimen into a position where nanowires are grown, the nanowires serve the role of a three dimensional cage to retain a liquid specimen until the specimen is crystallized thereby forming a crystal center of the specimen where the nanowires are located. When the size of the crystal center of the specimen is adjusted to a size tantamount to the diameter of laser to be irradiated, only 1 to 2 times of laser irradiations will sufficiently promote the desorption/ionization of the specimen that enables the measurement of its molecular weight thus allowing the quantitative analysis.

Or, in case of using a nanowire solution, the distributed nanowires serve the role of a cage to fix a specimen in the course of drying and thus it is possible to fix the specimen within the size of diameter of laser. Accordingly, only 1 to 2 times of laser irradiations will sufficiently promote the ionization of the specimen that enables the measurement of its molecular weight thus allowing the quantitative analysis.

The typical porous silicon has limitations on the selection of a suitable substance for the process and therefore there are also limitations on making effective utilization of laser energy. On the contrary, in case of desorption/ionization using nanowires according to the present invention, the laser energy being transferred to a specimen can be appropriately adjusted within the scope of desired energy level using nanowires having various energy gaps.

In case of DIOS using the typical porous silicon, there is a disadvantage that the porous structure should be used only in the limited area. That is, the specimen solution penetrates a porous structure and becomes crystallized in the course of injecting the specimen solution and drying and thus the crystalline size of the specimen is not limited. In contrast, in case of NADI according to the present invention, the specimen is crystallized using a nanowire cage and thus the crystalline size of the specimen can be limited.

Further, in NADI of the present invention using nanowires, unlike in the case of DIOS using the typical porous silicon wherein recycling of used targets is difficult, it is possible to recycle used targets after appropriate washes by using the conventional metal plate as a target.

In case of DIOS, it has been reported that DIOS efficiency becomes deteriorated due to oxidation and thus it should be kept sealed. However, the target plates using nanowires can use oxidized products and thus it allows easy packaging and also long-term storage at atmospheric environment is made possible.

In order to show that mass spectrometric analysis is possible by using NADI method without matrix, experiments were done using ZnO nanowire chips and peptides. ZnO nanowire chips were prepared by depositing a surface of the silicon board with Au, which serves as a catalyst, via sputtering vapor deposition method to a thickness of 2 nm to a predetermined area, and supplying diethylzinc and oxygen at 500° C. via chemical vapor deposition method, thereby allowing growth of ZnO nanowires on a selected area. The target plate where the board with thus prepared nanowires was inserted into specimen inspection plate of a mass spectrometric analysis device was manufactured as shown in FIG. 1.

In FIG. 1, reference numeral 1 indicates inspection plate, reference numeral 2 indicates a target plate, reference numeral 3 indicates a board and reference numeral 4 indicates nanowire spot. FIG. 1(*a*) shows a picture of a board that formed ZnO nanowire spot and a target plate where the board was inserted to specimen inspection plate of a mass spectrometric analysis device. FIG. 1(*b*) and (*c*) show an enlarged picture of grown nanowires taken by scanning electron microscope. The ZnO growth conditions for nanowires grown on nanowire spot (4) were restricted to have an average diameter of is 100 nm, an average length of 3 μm, an average density of about $1\times10^6$ nanowire(NWs)/$mm^2$. The diameter of nanowire spot (4) was restricted to be 0.2 mm and the crystals of specimens were irradiated by the circular spot of laser (diameter: 0.2 mm) for the ionization of specimens. As stated, the majority of specimen crystals is exposed to laser and thus the ionized amount of a specimen through the crystalline surface of the specimen was made to have a quantitative relationship with the concentration of the specimen.

For mass analysis, Reflex 3 from Bruker Daltonics (Germany) was used.

For a specimen, angiotensin as a peptide (MW 1014, Sigma Chemical Co., USA) and leucine enkephalin (MW 588, Sigma Chemical Co., USA) were used, respectively.

FIG. 2 is a graph showing the peak of molecular weight after laser irradiation on ZnO nanowires without a specimen. As shown in FIG. 2, ZnO nanowires do not generate a peak of molecular weight which may raise confusion with the peak of a specimen.

FIG. 3 shows a result of mass analysis after adding leucine enkephalin to ZnO nanowires chip with the concentration of 0.13, 0.25, 0.50 and 1.0 mg/mL, respectively. From the above result, it is known that mass analysis is possible by using ZnO nanowires chip. Further, mass comparison result according to the respective concentration of the ZnO nanowires chip reveals that the height of peak for the molecular weight of leucine enkephalin and the above concentration has a quantitative relationship.

FIG. 4 shows a result of mass analysis after adding angiotensin to ZnO nanowires chip with the concentration of 0.25, 0.50 and 1.0 mg/mL, respectively. As is the case with leucine enkephalin, mass comparison result reveals that the height of peak for the molecular weight of angiotensin and the above concentration has a quantitative relationship.

As stated above, it is possible to perform mass spectrometric analysis without using matrix when using a nanowire chip target plate according to the present invention, and it also shows that quantitative analysis is possible. In performing mass analysis using the same specimens and the typical metal target plate for the comparison purpose, when Chloangiocarcinoma (CCA) was used as a matrix both the peak of CCA and the peak of peptide were obtained, however, when matrix was not used there was no peak of molecular weight was observed even in a high concentration specimen. That is, it was not possible to perform mass analysis of a specimen when the typical metal target plate was used without a matrix.

Meanwhile, in DIOS method using porous silicon, which enables to perform mass analysis without the use of a typical matrix, there is a limitation in using substances for energy transfer because it does not allow other substances to be used except silicon. On the contrary, in using MALDI target of the present invention, it is possible to select nanowire substances with various kinds of energy gap and thus can control the laser energy being transferred within a desired range according to the specimen. The enforcement of DIOS based on the bandgaps and DIOS experiments using peptides according to the various nanowire substances are shown in the following table 1.

TABLE 1

| Nanowire Substance | Bandgap (eV) | Enforcement of DIOS |
|---|---|---|
| ZnO | 3.2 | possible |
| SiC | 2.4 | possible |
| SnO2 | 3.6 | possible |
| GaN | 3.4 | possible |
| Si | 1.11 | possible |

In the present invention, there is provided a method using nanowire suspension via a metal target plate used in the typical MALDI for quantitative analysis instead of nanowire spot. This method enables to perform mass analysis within the range of molecular weight of 1,000 dalton by using the metal target plate without deformation without using nanowire spot and without interference with the peak of matrix.

As explained in the above quantitative analysis using nanowire chip, nanowire islet was formed focusing on one spot of the metal target plate so that the crystal center of a specimen can correspond to the position of laser irradiation, and for this purpose was used a target plate with arranged ankers (MTP plate, Bruker Co., Germany).

The anker point of the target plate is the place where a solvent of a specimen is dried to form crystals in case of an aqueous specimen. In the present invention, nanowire islet was forced to heavily form in these anker points while the solvent of the nanowire suspension prepared in an aqueous solution becomes dried. That is, nanowire islet was formed by mixing nanowire suspension with volatile isopropanol and dividing it into a metal target plate. In addition, specimen crystals were prepared by dividing a small amount of specimen into a nanowire islet followed by drying. In FIG. 5, nanowire suspensions of ZnO, SiC, $SnO_2$, GaN were used. Here, nanowire chip (the board where nanowires are grown) grown to the density of about 5000 NWs/mm$^2$ in silicon board was placed in distilled water and separated nanowires by applying ultrasonic wave thereby manufacturing a nanowire suspension where the nanowires made of the above-mentioned substance and distilled water.

FIG. 5 shows peaks of molecular weight of peptides obtained by using the above four different kinds of nanowires. After forming nanowire islets on the target plate with arranged ankers as mentioned above, leucine enkephalin (MW 1014, Sigma Chemical Co., USA) as a peptide was prepared to a concentration of 0.5 mg/mL and then added 10 μL to each nanowire islet and dried at room temperature. For mass analysis, Reflex 3 from Bruker Daltonics (Germany) was used.

Porous silicon has been reported that its DIOS efficiency is greatly reduced due to oxidation and thus the target plate for DIOS made of commercial porous silicon is packed individually using argon as a disposable. As shown in the above table 1, the target plate using nanowires can use oxidized products and thus provide relatively easy packaging and also it can be stored for a long period of time at atmospheric conditions. Further, in a target plate of the present invention where nanowires are used in the typical metal plate, it can be reused after appropriate washes. On the contrary, in a target plate for DIOS using porous silicon, it is not possible to wash specimen crystals in the used target plates because of the structural problems of porous silicon. Therefore, DIOS target plate for using porous silicon is discarded after a single use. On the contrary, in target plates using nanowires, target plates can be reused after sequential washes with distilled water, isopropyl alcohol, acetone, etc. as is the case with metal target plates.

FIG. 6 shows the result of mass analysis of leucine enkephalin (MW 1014, Sigma Chemical Co., USA) at a concentration of 0.5 mg/mL after recyclings via 10 times of washes of ZnO nanowire chip. The result clearly shows that nanowire chip can be reused after washing.

Further, when a suspension manufactured by mixing nanowires and a specimen by using the typical metal target is sprayed onto a MALDI target board the resulting specimen becomes uniformly distributed and laser energy can be effectively absorbed by the crystals of the specimen. Therefore, in consideration of this, excellent mass analysis effect can be achieved while retaining the unique features of the typical MALDI target that allows recycling.

BRIEF DESCRIPTION OF DRAWINGS

The above and other objects and features of the present invention will become apparent from the following description of the invention, when taken in conjunction with the accompanying drawings, wherein:

FIGS. 1(*b*) and (*c*) show an enlarged picture of grown nanowires taken by scanning electron microscope;

The method of mass spectrometric analysis using nanowire according to the desorption/ionization of the present invention is set forth hereunder based on the following Examples, however, they should not be construed as limiting the scope of this invention.

EXAMPLES

Example 1

Mass Spectrometric Analysis using Nanowires

Figure 1:
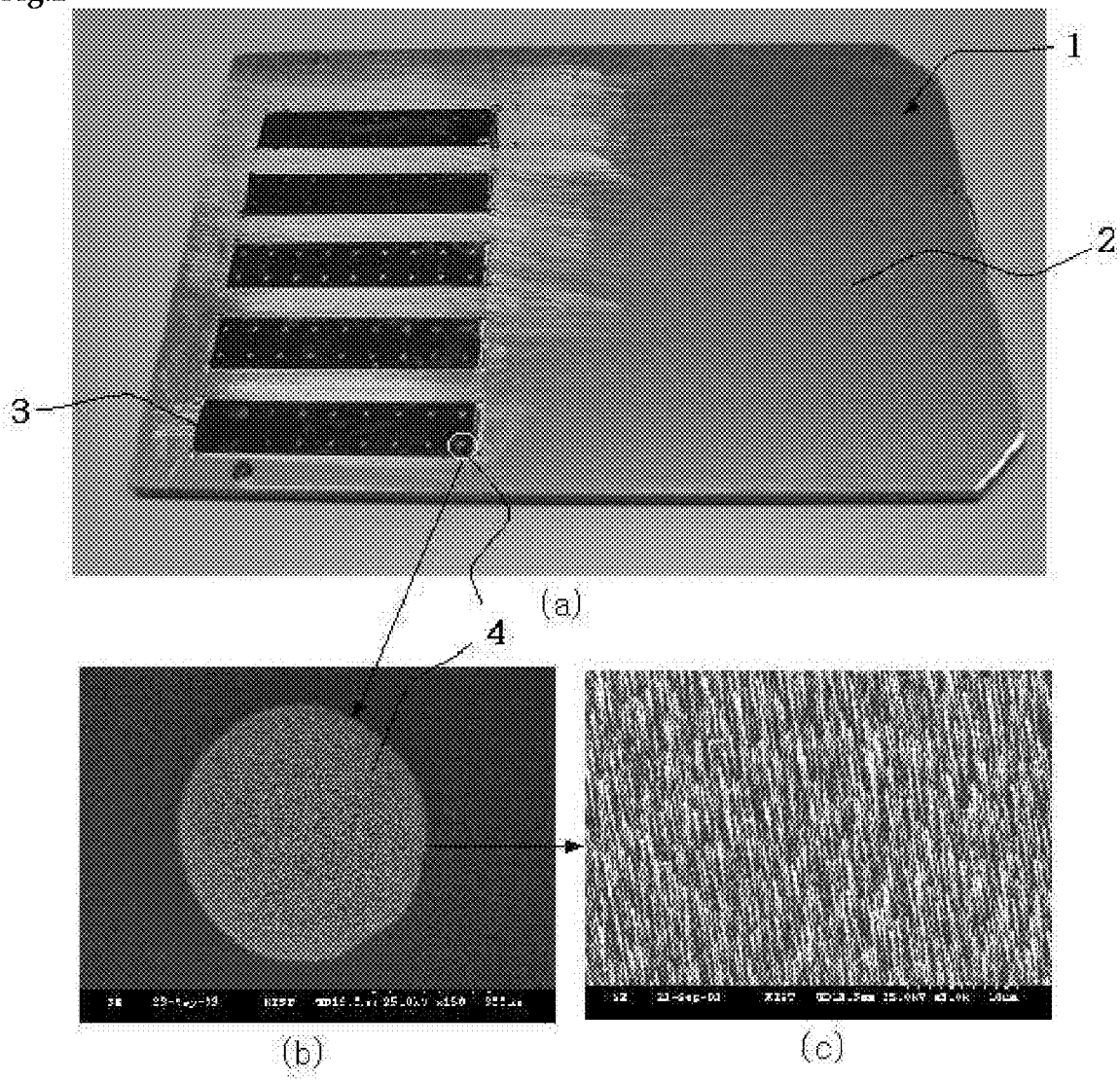
FIG. 1(*a*) shows a picture of a board that formed ZnO nanowire spot and a target plate where the board was inserted to specimen inspection plate of a mass spectrometric analysis device.
Figure 2:
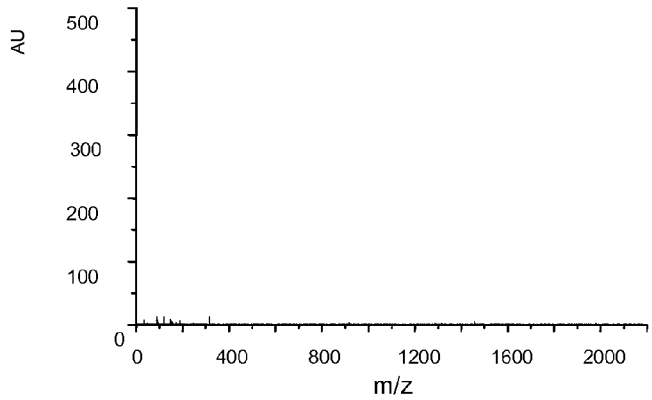
FIG. 2 is a graph showing the peak of molecular weight after laser irradiation on ZnO nanowires without a specimen.
Figure 3:
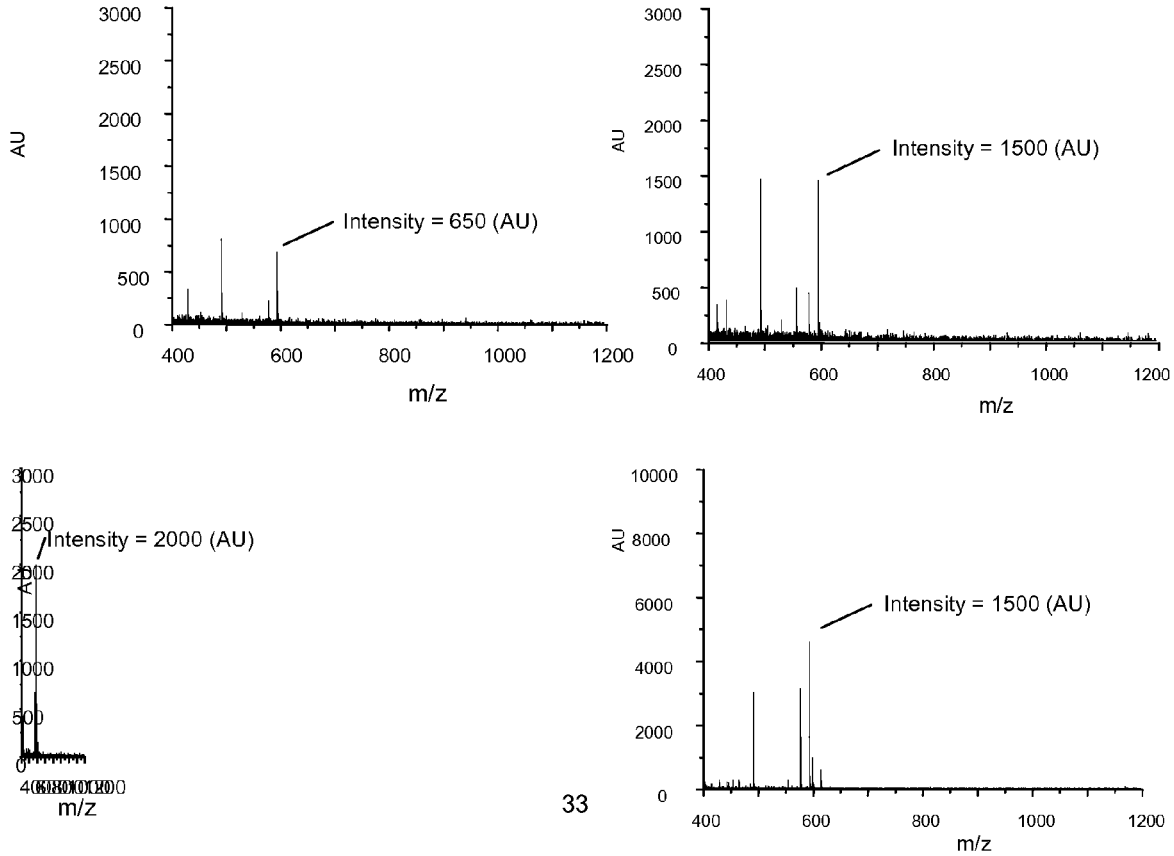
FIG. 3 shows a result of mass analysis after adding leucine enkephalin to ZnO nanowires chip with the concentration of 0.13, 0.25, 0.50 and 1.0 mg/mL, respectively.
Figure 4:
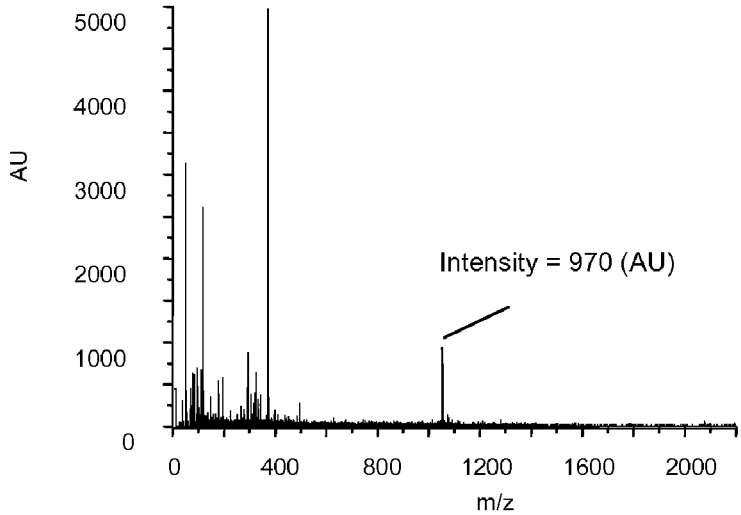
FIG. 4 shows a result of mass analysis after adding angiotensin to ZnO nanowires chip with the concentration of 0.25, 0.50 and 1.0 mg/mL, respectively.
Figure 4:
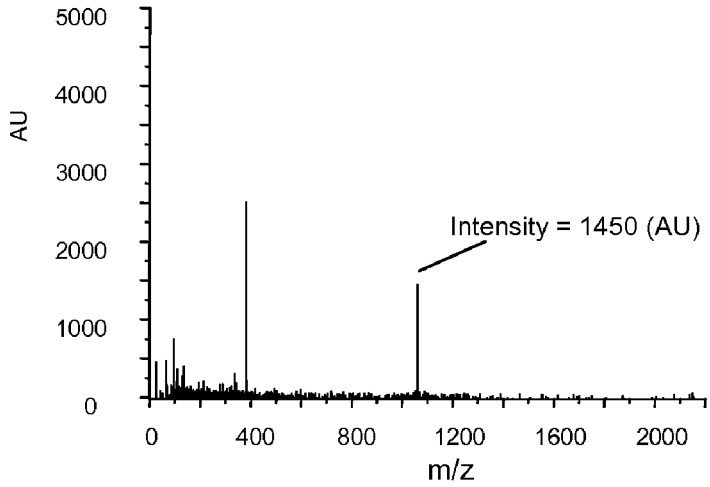
Figure 4:
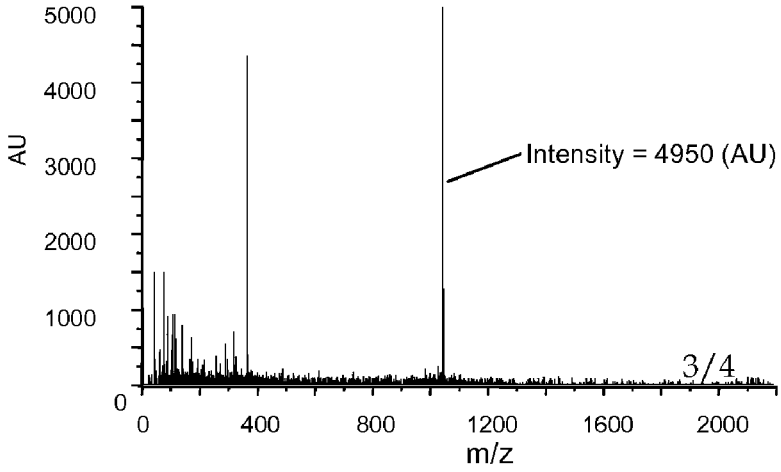
Figure 5:
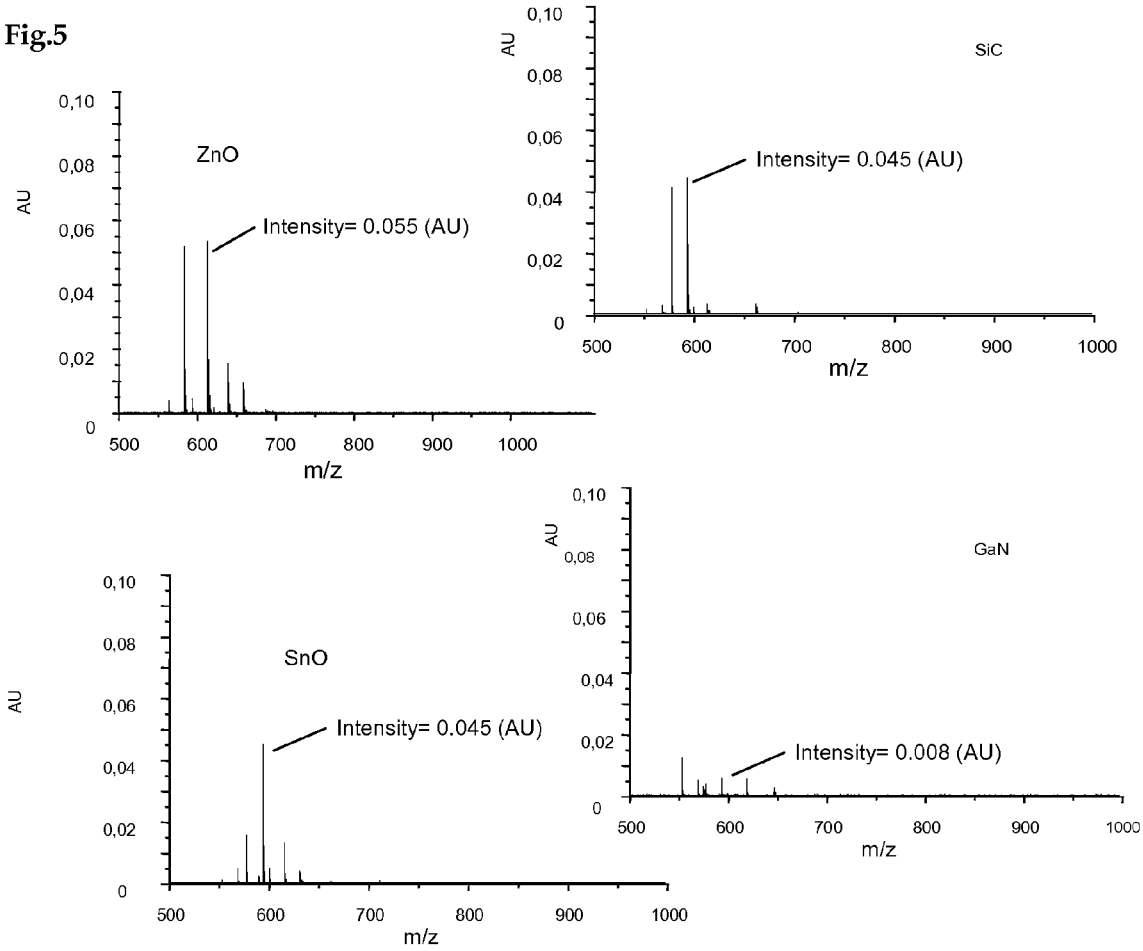
FIG. 5 shows peaks of molecular weight of peptides obtained by using the above four different kinds of nanowire suspensions of ZnO, SiC, $SnO_2$, GaN.
Figure 6:
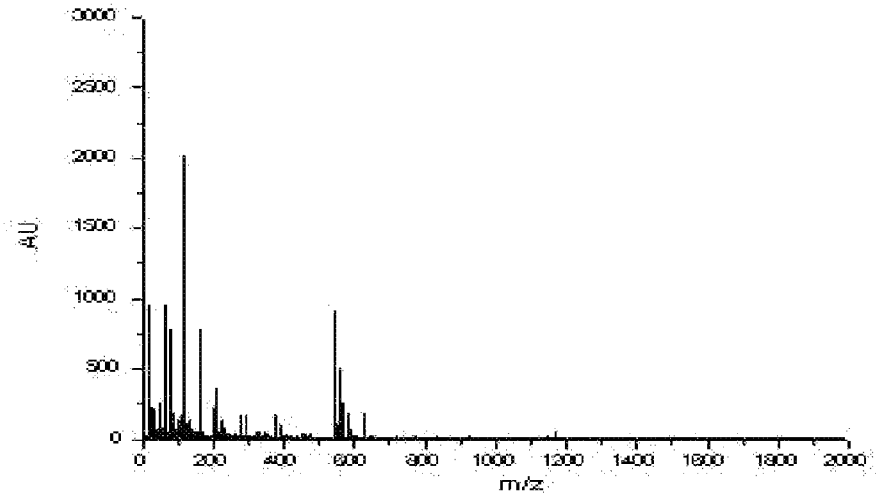
FIG. 6 shows the result of mass analysis of leucine enkephalin at a concentration of 0.5 mg/mL after recyclings via 10 times of washes of ZnO nanowire chip, wherein reference numeral 1 indicates inspection plate, reference numeral 2 indicates a target plate, reference numeral 3 indicates a board and reference numeral 4 indicates nanowire spot.

A surface of a silicon board was deposited with Au via sputtering vapor deposition method to a thickness of 2 nm, wherein the area for deposition was made circular with a diameter of 200 μm using a mask. Then, the board was supplied with $SiCl_4$ at 500° C. via chemical vapor deposition (CVD) method, thereby allowing the growth of silicon nanowires, and FIG. 1 shows the silicon nanowires grown on the board. The silicon nanowires used were restricted to have a length of 5 μm, a diameter of 100 nm and a density of about $1.8\times10^6$ NWs/mm$^2$. The board with thus grown nanowires was inserted into a specimen inspection plate of a mass spectrometric analysis device. The mass analysis was performed using Reflex 3 from Bruker Daltonics (Germany). The specimens used were two peptides, angiotensin and leucine enkephalin. The diameter of nanowire spot was restricted to be 0.2 mm and the crystals of specimens were irradiated by the circular spot of laser (diameter: 0.2 mm) for the ionization of specimens. As stated, the majority of specimen crystals are exposed to laser and thus the ionized amount of a specimen was made to have a quantitative relationship with the amount of the specimen. Upon inspection, it was found that mass analysis of peptides via MALDI using nanowire specimen plate without matrix. When a specimen inspection plate of a mass spectrometric analysis device was used for comparison of results, it was not possible to perform mass spectrometric analysis of peptides. Further, it was found from the experiments that quantitation of specimens are possible by using the above method.

Example 2

Mass Spectrometric Analysis using Nanowire Suspension

A surface of a silicon board was deposited with Au via sputtering vapor deposition method to a thickness of 2 nm, wherein InN nanowires were grown by supplying with $InCl_3$ and $NH_3$ at 500° C. via chemical vapor deposition (CVD) method. Nanowire suspension was prepared by separating nanowires from the board by placing the above silicon board in isopropyl alcohol and then applying with ultrasonic wave for 10 sec. The MALDI measurement was performed using the nanowire suspension by using MALDI target from Bruker Daltonics (Germany) instead of the typical matrix. Taking advantage of the special property of the MALDI target that crystal center of a specimen is concentrated on ankers, a small amount of nanowire suspension was treated to form nanowire islets around the ankers. Then, peptides as a specimen was dropped in the above nanowire islets and allowed to form crystals of the specimen. Upon inspection, it was found that nanowire suspsension can replace matrix and quantitative results were obtained as a result.

Example 3

Detection of Coupling Reaction using Nanowires

A nanowire target where nanowires are grown as in Example 1 was added with hepatitis B antigen solution and allowed to incubate at a 37° C. water-saturated thermostat for an hour so that the hepatitis B antigen can be fixed. Then, the nanowire target was dipped into a washing solution to separate unfixed hepatitis B antigens. A specimen solution containing the hepatitis B antigen was added to the nanowires to induce an antibody-antigen reaction and then placed the nanowire target into the washing solution to remove the specimen which was left after the antibody-antigen reaction. Then, it was confirmed that MALDI enables to perform quantitative as well as qualitative analyses of antigen-antibody coupler which was coupled to nanowires. Likewise, it is possible to quantitatively detect the couplers between DNAs, between DNA and RNA or between proteins using the nanowire MALDI target. Further, it is also possible to quantitatively detect the couplers between ligands, such as organics and inorganics, and receptors.

INDUSTRIAL APPLICABILITY

As stated above, according to the nanowire-assisted laser desorption/ionization mass spectrometric analysis, mass analysis of a specimen is possible by using nanowires which can fix a specimen and perform desorption/ionization of the specimen while effectively transferring laser energy being irradiated onto the specimen, without matrix.

That is, the present invention, by using the above nanowires, enables to effectively perform desorption/ionization of a specimen using the above-mentioned nanowire, thereby effectively performing qualitative-, quantitative-, and micro-analyses of specimens as well as low molecular weighted specimens. Further, this invention also enables to the typical device of mass spectrometric analysis used in MALDI-T of MS.

The invention has been described in detail with reference to preferred embodiments thereof. However, it will be appreciated that those skilled in the art, upon consideration of the disclosure, may make modifications and improvements within the scope and spirit of the invention.

The invention claimed is:

1. A nanowire-assisted method for mass spectrometric analysis of a specimen via desorption/ionization using laser as an energy source comprising:

(a) forming a nanowire spot by growing a plurality of minute nanowires in a selected area of a conductive material or a semiconductor board capable of applying voltage;

(b) placing said specimen containing a substance to be analyzed in said nanowire spot and crystallizing by drying; and (c) performing mass spectrometric analysis of said specimen containing a substance to be analyzed in a state where voltage is applied in said board, while simultaneously irradiating laser onto said nanowire spot, wherein said specimen is adsorbed to and crystallized in said nanowire under reduced pressure, to transfer energy to said specimen through said nanowire.

2. In forming a nanowire spot in claim 1, said nanowire has a diameter of 500 nm or less and an aspect ratio of 10 or higher is allowed to grow.

3. In forming a nanowire spot in claim 1, said nanowire to be grown is selected from the group consisting of a single metal containing silicon, oxide, carbide, nitride, phosphide and arsenide semiconductor nanowires.

4. In forming a nanowire spot in claim 1, the area of said nanowire spot is formed so that it is equal to or smaller than the area for laser irradiation.

5. In claim 1, said specimen comprises a salt and a material to be analyzed, wherein the concentration of said salt is greater than 10 mM.

6. In claim 5, the concentration of said material to be analyzed in said specimen is contained less than 1 femto mole.

7. In claim 1, said laser to be irradiated has an energy greater than the bandgap of the nanowires grown in said semiconductor board according to the kind of nanowires to be selected.

8. In claim 1, the value of mass over electric charge (m/z) of ions is measured while performing mass spectrometric analysis of said ionized material.

9. A nanowire-assisted method for mass spectrometric analysis of a specimen via desorption/ionization using laser as an energy source comprising;

(a) manufacturing nanowire suspension containing a plurality of minute nanowires;

(b) forming a nanowire spot after drying said nanowire suspension coated on the selected area of a conductive material or a semiconductor board capable of applying voltage;

(c) placing said specimen containing a substance to be analyzed in said nanowire spot and crystallizing by drying; and (d) performing mass spectrometric analysis of said specimen containing a substance to be analyzed in a state where voltage is applied in said board, while simultaneously irradiating laser onto said nanowire spot, wherein said specimen is adsorbed to and crystallized in said nanowire under reduced pressure, to transfer energy to said specimen through said nanowire.

10. In manufacturing nanowire islet in claim 9, said nanowire suspension is manufactured as a mixed state of comprising nanowire in a volatile solution by separating nanowires from a semiconductor board by applying ultrasonic wave after placing said semiconductor board, wherein nanowires are grown, into said volatile solution.

11. In manufacturing nanowire suspension in claim 9, said nanowire has a diameter of 500 nm or less and an aspect ratio of 10 or higher.

12. In manufacturing nanowire suspension in claim 9, said nanowire to be grown is selected from the group consisting of a single metal containing silicon, oxide, carbide, nitride, phosphide and arsenide semiconductor nanowires.

13. In manufacturing nanowire islet in claim 9, said nanowire suspension is formed by spraying on the selected area of said semiconductor board.

14. In manufacturing nanowire islet in claim 9, the area of said nanowire spot is formed so that it is equal to or smaller than the area for laser irradiation.

15. In claim 9, said specimen comprises a salt and a material to be analyzed, wherein the concentration of said salt is greater than 10 mM.

16. In claim 9, the concentration of said material to be analyzed in said specimen is contained less than 1 femto mole.

17. In claim 9, said laser to be irradiated has an energy greater than the bandgap of the nanowires grown in said semiconductor board according to the kind of nanowires to be selected.

18. In claim 9, the value of mass over electric charge (m/z) of ions is measured while performing mass spectrometric analysis of said ionized material.

19. A nanowire-assisted method for mass spectrometric analysis of a specimen via desorption/ionization using laser as an energy source comprising;

(a) manufacturing nanowire suspension by mixing a sample solution containing a plurality of minute nanowires and materials to be analyzed;

(b) forming a nanowire islet comprising nanowire and a specimen adsorbed and crystallized to said nanowire after drying said nanowire suspension coated on the selected area of a conductive material or a semiconductor board capable of applying voltage;

(c) performing mass spectrometric analysis of said ionized material to be analyzed in a state where voltage is applied in said board, while simultaneously irradiating laser onto said nanowire islet under reduced pressure to transfer energy to said specimen through said nanowire.

20. In manufacturing nanowire suspension in claim 19, said nanowire has a diameter of 500 nm or less and an aspect ratio of 10 or higher.

21. In manufacturing nanowire suspension in claim 19, said nanowire to be grown is selected from the group consisting of a single metal containing silicon, oxide, carbide, nitride, phosphide and arsenide semiconductor nanowires.

22. In claim 19, said specimen comprises a salt and a material to be analyzed, wherein the concentration of said salt is greater than 10 mM.

23. In claim 19, the concentration of said material to be analyzed in said specimen is contained less than 1 femto mole.

24. In manufacturing nanowire islet in claim 19, said nanowire suspension is formed by spraying on the selected area of said semiconductor board.

25. In claim 19, the area of said nanowire spot is formed so that it is equal to or smaller than the area for laser irradiation.

26. In claim 19, said laser to be irradiated has an energy greater than the bandgap of the nanowires grown in said semiconductor board according to the kind of nanowires to be selected.

27. In claim 19, the value of mass over electric charge (m/z) of ions is measured while performing mass spectrometric analysis of said ionized material.

* * * * *